United States Patent [19]

Terada et al.

[11] Patent Number: 4,756,805

[45] Date of Patent: Jul. 12, 1988

[54] TREATMENT OF GALVANIZED STEEL

[75] Inventors: Haruyoshi Terada, Tokyo; Akimitsu Fukuda, Chiba; Yohji Oho, Tokyo, all of Japan

[73] Assignee: Nihon Parkerizing Co., Ltd., Tokyo, Japan

[21] Appl. No.: 918,409

[22] Filed: Oct. 14, 1986

[30] Foreign Application Priority Data

Nov. 1, 1985 [JP] Japan ..... 60-244063

[51] Int. Cl.[4] ..... C25D 11/38

[52] U.S. Cl. ..... 204/35.1; 204/38.4; 204/41; 204/56.1

[58] Field of Search ..... 204/35.1, 38.1, 38.4, 204/40, 41, 56.1; 148/6.2

[56] References Cited

U.S. PATENT DOCUMENTS 3,880,772 4/1975 Rekertas et al. ..... 252/387

4,003,760 1/1977 Labenski et al. ..... 148/6.2

4,137,132 1/1979 Ward et al. ..... 204/38.1

4,578,122 3/1986 Crotty ..... 148/6.2

OTHER PUBLICATIONS

F. A. Lowenheim, *Electroplating*, McGraw-Hill Book Co., New York, 1978, pp. 442–447.

*Primary Examiner*—John F. Niebling

*Assistant Examiner*—William T. Leader

*Attorney, Agent, or Firm*—Arthur E. Kluegel

[57] ABSTRACT

A method of treating a zinc plated steel surface provides improved corrosion resistance and painting properties. The surface is rendered cathodic in the presence of an aqueous treatment liquor containing 5–70 g/l of hexavalent chromium, 0.01 to 5 g/l of trivalent chromium, 5–100 g/l of silica and/or silicate and 0.05–10 g/l of nitrate in which the ratio of $Cr^{3+}/Cr^{6+}$ is within the range 1/50–⅓.

4 Claims, 1 Drawing Sheet

METAL TREATED: ZINC ELECTROPLATED STEEL SHEET

METAL TREATED: ZINC ELECTROPLATED STEEL SHEET

TREATMENT OF GALVANIZED STEEL

BACKGROUND OF THE INVENTION

This invention concerns a method for the surface treatment of zinc plated steel sheets in which a composite film of chromate and silica which has excellent corrosion resistance, paint binding properties and film uniformity is formed on the surface of galvanized steel such as molten zinc plated steel, zinc electroplated steel, zonc alloy electroplated steel and alloy zinc plated steel.

Conventional methods of treatment in which $Cr^{6+}$, $Cr^{3+}$-silica based treatment liquors are used have been disclosed in Japanese Pat. No. 42-14050 (1967), Japanese Pat. No. 45-38891 (1970), Japanese Patent Kokai No. 52-17340 (1977), and Japanese Patent Kokai No. 52-17341 (1977) and various metods of coating have been used. However, when the extent of film formation is increased to improve the corrosion resistance, the amount of silica attached is also increased along with the compounding ratio $Cr^{6+}$, $Cr^{3+}$/ silica in the treatment liquor and so the degree of adhesion between the metal which is being treated and the film which is formed is reduced. Thus, there is a tendency for the performance to become poor in respect of painting properties.

Furthermore, with these methods of coating, the concentration of the treatment liquor must be varied in order to control the extent of film formation or a device must be provided for changing the shape of the coating roll or the roll pressure and so it is diffcult to change the extent of film formation quickly and to achieve the correct control. There is a further difficulty in that here are other problems with these methods of coating such as a lack of uniformity of the film.

Methods of cathodic electrolysis treatment in $Cr^{6+}$ treatment liquors have been indicated in Japanese Pat. No. 47-44417 (1972) (a method in which zinc plated steel sheets are subjected to a cathodic electrolysis treatment in a $CrO_3$-$H_2SO_4$ treatment liquor) and Japanese Pat. No. 48-43019 (1973) (a method in which a cathodic electrolysis treatment is carried out in a $CrO_3$ - heavy metal ion based treatment liquor). In general, the films which are formed by means of a cathodic electrolysis treatment in a $Cr^{6+}$ treatment liquor have inadequate corrosion resistance but they are said to have excellent painting properties. However, the painting properties have not always been satisfactory in industrial terms.

Furthermore, the following problems arise with these conventional cathodic electrolysis treatments in $Cr^{6+}$ based treatment liquors in connection with the achievement of a surface treatment which is stable industrially. Thus, when zinc plated steel sheet is treated continuously, zinc ions are dissolved into the liquor and the $Cr^{3+}$ ions which are produced by a reduction reaction during the cathodic electrolysis are precipitated due to the increase in the pH of the treatment liquor so the stability of the treatment liquor is poor. Moreover, there is a change in the external appearance of the film which is formed and problems also arise with worsening corrosion resistance.

This invention is intended to provide an improvment in respect to the difficulties experienced with controlling the extent of film formation and the poorer painting properties observed when the extent of film formation is increased, the disadvantages of the conventional $Cr^{6+}$, $Cr^{3+}$- silica based treatment liquor coating methods, to improve upon the variations in external appearance of the film and the stability of the treatment liquor and the poorer corrosion resistance which arise during continuous operation, the disadvantages of the conventional cathodic electrolysis treatment methods, and to provide for the industrially stable formation of films which have superior external appearance, corrosion resistance, and painting properties on the surfaces of zinc plated steel sheets.

SUMMARY OF THE INVENTION

It has been discovered that the aforementioned problems can be overcome by using a cathodic electrolysis treatment of the surface of zinc plated steel in a treatment liquor which contains 5–70 grams/liter of $Cr^{6+}$, 0.01–5.0 grams/liter of $Cr^{3+}$, 5–100 grams/liter of silica and/or silicate and 0.05–10 grams/liter of $NO_3$- ion in which the ratio $Cr^{3+}/Cr^{6+}$ is 1/50–⅓.

DETAILED DESCRIPTION OF THE INVENTION

Figure 1:
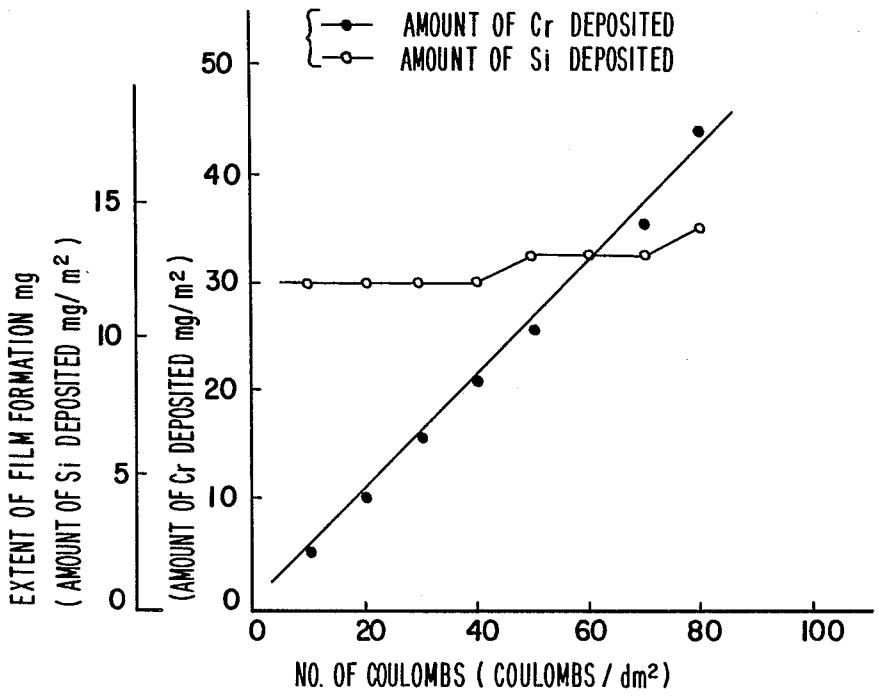
FIG. 1 is a graph which shows the relationship between the extent of film formation and the number of coulombs when a zinc electroplated steel sheet is subjected to cathodic electrolysis.

Anhydrous chromic acid, ammonium bichromate, and alkali metal salts of bichromic acid can be used alone or in the form of mixtures for the $Cr^{6+}$ in the treatment liquor in this invention. The concentration of the $Cr^{6+}$ is 5–70 grams/liter and preferably 10–50 grams/liter. In general, the formation efficiency of the film falls when the metal being treated is treated continuously in cases where the $Cr^{6+}$ concentration is low and it is difficult to form a uniform film under these conditions and so in order to achieve industrially stable treatment, a $Cr^{6+}$ concentration of at least 5 grams/liter is required. However, in cases where the $Cr^{6+}$ concentration exceeds 70 grams/liter, there is no further improvement to be seen in the performance of the film which is formed and this is undesirable because more of the covering zinc is dissolved away at such high concentrations. Furthermore, the amount of treament liquor which is dragged out by the metal which is being treated is increased and so this is also undesirable from an economic point of view. Hence, industrially a limit of 70 grams/liter has been set for the $Cr^{6+}$concentration.

$Cr^{3+}$ nitrate and carbonate compounds can be used to supply the $Cr^{3+}$ ion or alternately the reaction products of oxidation reduction reactions of $Cr^{6+}$ and organic compounds such as alcohols, starch, tannic acid, etc. added to the treatment liquor can be used as a source of $Cr^{3+}$ ions. The film forming efficiency with respect to the number of coulombs in the cathodic electrolysis treatment is raised by including the $Cr^{3+}$ ion and it is possible to obtain films which have better corrosion resistance and painting properties in this way. The concentration of the $Cr^{3+}$ ion is set at 0.01–5.0 grams/liter and preferably at 0.05–5 grams/liter and the ratio $Cr^{3+}/Cr^{6+}$ is set at 1/50⅓. The desired effects described above are slight if the $Cr^{3+}/Cr^{6+}$ ration is less than 1/50 and the painting properties decline if the value of this ratio is greater than ⅓.

In this invention, silica or silicate is added to the treatment liquor in order to form colloidal silica and it is generally stated that in water this material is present in the form of very fine (1–100 mμ) particles of anhydrous silicic acid which carry a negative charge. The concentration of silica and/or silicate is set at 5–100 grams/liter and concentrations of 10–50 grams/liter are particularly desirable. At concentrations of less than 5 grams/liter it is difficult to form a film having the corrosion resistance and the painting properties, which is to say the attachment of the paint film, is poor. Furthermore, if the concentration is greater than 100 grams/liter, there is no further increase in effectiveness, the silica and silicate dispersion may become unstable, and the amount of treatment liquor taken out of the system by the metal which is being treated is considerable and this is uneconomical and so the limit for silica and silicate is set industrially at 100 grams/liter.

Nitric acid, ammonium nitrate, and alkali metal nitrates can be used alone or in the form of mixtures as required for the $NO_3-$ ion which is added to the treatment liquor in this invention. The concentration of the $NO_3-$ ion is set at 0.05–10 grams/liter and preferably at 0.1–3 grams/liter. If the nitrate ion concentration is less than 0.05 grams/liter, it is difficult to form a good film and the corrosion resistance and the painting properties are poor as shown by Reference Example 3 in Table 3. Furthermore, if the nitrate ion concentration is higher than 10 grams/liter there is no change to be seen in the properties of the film which is formed but the amount of covering zinc which is dissolved at such high concentrations is considerable and the extent of the film which is formed is reduced and so this is undesirable.

The pH of the treatment liquor is unspecified but the preferred results are obtained by selecting any pH value within the range of 1–6. There is no change in the properties of films which are formed with the treatment liquors which have a pH of less than 1 but more of the covering zinc is dissolved under these conditions and the extent of film formation tends to be reduced. Furthermore, there is no change in the properties of the films which are formed when the pH is higher than 6 but such conditions are undesirable since they result in a sedimentation of the silica and silicate. The pH is limited to 6 for the execution of a treatment which is industrially stable.

Any conventional acidic and alkaline material which does not add deleterious ingredients such as ammonium hydroxide, the alkali metal hydroxides, and the alkali metal carbonates can be added to the treatment liquor for controlling the pH value of the treatment liquor.

The temperature of the treatment liquor is set at from room temperature to 70° C. There is no change in the properties of the film which is formed if the temperature is higher than 70° C. but since this is uneconomical, an upper limit has been set industrially at 70° C.

The cathodic electrolysis treatment is carried out using the zinc plated steel sheet as the cathode but the surface of the metal which is to be treated must be cleaned before this treatment. However, the effect of the invention can be achieved in part even if the surface is not perfectly clean. The current density at the cathode is set within the range of 3–80 $A/dm^2$. Thus, if the current density is less than 3 $A/cm^2$, it is difficult to form a good film and the corrosion resistance and the painting properties become poor. Furthermore, there is no increase in effectiveness if the current density is higher than 80 $A/dm^2$.

Finally, the cathodic electrolysis treatment time is controlled in order to set the amount of attached chromium in the film which is formed within the prescribed range. Various factors affect the extent of chromium disposition, but in the method of this invention the concentrations of the various components of the treatment liquor, the pH, the temperature, and the current density are fixed to the respective preferred conditions and the prescribed amount of chromium deposited is controlled by changing the electrolysis time. Conversely, the amount of deposited chromium can be controlled by fixing the electrolysis time and varying the current density.

A graph obtained when the metal being treated was a zinc electroplated steel sheet is shown in FIG. 1 as an example of the relationship between the number of coulombs and the extent of film formation in this invention. The composition of the treatment liquor and the electrolysis conditions used to obtain this graph were as shown in Table 7.

It is clear from FIG. 1 that with a film which is formed by means of this invention the amount of deposited chromium can be controlled easily by means of the product of the current density during the cathodic electrolysis and the electrolysis time, which is to say the number of coulombs, but the amount of silica which is deposited is virtually independent of the cathodic electrolysis conditions and is more or less constant and so the difficulties of the coating methods mentioned earlier, which is to say the increase in the amount of silica deposited when the extent of film formation is increased to improve the corrosion resistance, the poor adhesion of the film which is formed and the reduced level of painting properties, can be improved upon and it is possible to obtain uniform films which have superior corrosion resistance, film adhesion and paint adhesion properties.

The preferred amount of attached chromium in this invention is 10–300 $mg/m^2$ and the most desirable range is 20–150 $mg/m^2$. The preferred amount of attached silica is 3–30 $mg/m^2$ as Si and the most desirable range in this case is 5–20 $mg/m^2$.

It was mentioned that the corrosion resistance of the film which is formed is improved in this invention by the presence of 0.05–10 grams/liter of $NO_3-$ ion in the treatment liquor. Nitrate also results in an improvement in the stability of the treatment liquor during continuous treatment and in the variation in the external appearance of the film, the disadvantages of the conventional cathodic electrolysis methods. That is to say, when zinc plated steel sheets are being treated continuously, the $Cr^{3+}$ ions and the zinc ions which accumulate in the treatment liquor combine with the $NO_3-$ ions and become soluble and the stability of the treatment liquor is improved because the precipitation of these metal ions is prevented. Consequently, there is no loss of corrosion resistance or worsening of the painting properties of the films which are being formed even in the case of a continuous treatment and there is an improvement in respect of the changes which occur in the appearance of the film and it is possible to obtain films which have an appearance which presents a better lustre in an industrially stable manner.

The zinc plated steel sheets which have been subjected to cathodic electrolysis treatment by means of this invention are dried after washing with water and the films can be used for corrosion prevention purposes or as an undercoating for painting. Furthermore, films which have been formed using the method of this invention can be after-treated as required with the aqueous chromate, or chromium-free solutions or anti-corrosion resin compounds which are generally used for this purpose.

EXAMPLES

The invention is described in concrete terms below by means of a few examples and reference examples.

EXAMPLE 1

Zinc electroplated steel sheet which has been cleaned using a known method was subjected to a cathodic electrolysis treatment under the conditions indicated below, washed with water after treatment and then dried. When the samples obtained in this way were compared with Reference Example 1, it was found that, as shown in Table 1, the film formed by means of a cathodic electrolysis treatment of this invention displayed better adhesion of the film, better uniformity, better corrosion resistance and better paint film adhesion properties than a conventional $Cr^{6+}$, $Cr^{3+}$ - silica based coated film.

| Composition of the Treatment Liquor | | |
|---|---|---|
| $Cr^{6+}$ | 22.0 grams/liter | (Anhydrous chromic acid) |
| $Cr^{3+}$ | 4.0 grams/liter | ($Cr^{6+}$ reduced with starch) |
| Snotex 0 | 250.0 grams/liter | (A colloidal solution containing 20% $SiO_2$, made by Nissan Chemicals) |
| $NO_3^-$ | 0.98 grams/liter | ($HNO_3$) |
| The pH at this time was 1.2 | | |
| Cathodic Electrolysis Conditions | | |
| Electrolysis Time | 3–12 Seconds | (Adjusted to obtain the prescribed amount of attached chromium) |
| Current Density | 10 A/dm$^2$ | |
| Electrolysis Temperature | 50° C. | |

REFERENCE EXAMPLE 1

Samples prepared by drying after physically coating with the treatment liquor used in Example 1 using a roll coating method onto a zinc electroplated steel sheet which has been cleaned using a known method were used for the reference samples in Table 1. On this occasion, the amount of chromium attached was adjusted by changing the extent of the coating by the treatment liquor.

EXAMPLE 2

Zinc electroplated steel sheet which has been cleaned using a known method was subjected to a cathodic electrolysis treatment under the conditions indicated below, washed with water after treatment and then dried and when the samples so obtained were compapred with Reference Example 2, it was found, as shown in Table 2, that the film formed by a cathodic electrolysis treament of this invention displayed better corrosion resistance and paint film attachment properties than the films obtained by the cathodic electrolysis treatment of Reference Example 2.

| Composition of the Treatment Liquor | | |
|---|---|---|
| $Cr^{6+}$ | 41.6 grams/liter | (Ammonium bichromate) |
| $Cr^{3+}$ | 2.4 grams/liter | (Basic chromium carbonate) |
| $SiO_2$ | 20.0 grams/liter | ($Na_2O.SiO_2$) |
| $NO_3^-$ | 0.98 grams/liter | ($HNO_3$) |

The pH was adjusted to 5.0 using ammonium bichromate.

REFERENCE EXAMPLE 2

Samples prepared by treating under the same cathodic electrolysis conditions as used in Example 2 a zinc electroplated steel sheet which ad been cleaned using a known method with a treatment liquor corresponding to that used in Example 2 but from which the $Na_2OSiO_2$ and $HNO_3$ had been omitted and a treatment liquor from which the $Na_2O.SiO_2$ or the $HNO_3$ had been omitted were used as the Reference Example 2 in Table 2.

EXAMPLE 3

Zinc electroplated steel sheet which had been cleaned using a known method was subjected to a cathodic electrolysis treatment under the conditions indicated below, washed with water after treatment and then dried and when the samples obtained in this way were compared with Reference Example 3, it was found that, as shown in Table 3, the film formed by means of a cathodic electrolysic treatment of this invention displayed better corrosion resistance better paint film attachment properties than the films obtained by the cathodic electrolysis treatment of Reference Example 3.

COMPOSITION OF THE TREATMENT LIQUOR

Using $HNO_3$ as a source of $NO_3-$ ion, $NO_3-$ ion was added at the rate of 0.06, 0.12, or 0.24 grams per liter to a treatment liquor consisting of 15.2 grams/liter of $Cr^{6+}$ (potassium chromate), 1.5 grams/liter of $Cr^{3+}$ ($Cr^{6+}$ reduced with tannic acid) and 10 grams/liter of "Aerosil 200" (see note below) and in each case the pH was adjusted to 5.0 using sodium hydroxide. (NOTE: $SiO_2$ powder, made by Nippon Aerosil.)

| Cathodic Electrolysis Conditions | |
|---|---|
| Electrolysis Time | 5 seconds |
| Current Density | 5 A/dm$^2$ |
| Electrolysis Temperature | 30° C. |

REFERENCE EXAMPLE 3

Samples prepared by treating zinc electroplated steel sheet which has been cleaned with a known method under the same cathodic electrolysis conditions as in Example 3 using a treatment liquor corresponding to that used in Example 3 but from which the $HNO_3$ had been omitted and a treatment liquor in which the $NO_3$-ion concentration was reduced to 0.03 grams/liter were used for Reference Example 3 in Table 3.

EXAMPLE 4

Zinc electroplated steel sheet which has been cleaned using a known method was subjected to a cathodic electrolysis treatment under the conditions indicated below, washed with water after treatment andthen dried and when the samples obtained in this way were compared with Reference Example 4 it was found that, as shown in Table 4, the film formed by means of a cathodic electrolysis treatment of this invention displayed better corrosion resistance and better paint film attachment properties than the films obtained with the cathodic electrolysis treatment of Reference Example 4.

COMPOSITION OF THE TREATMENT LIQUOR

"Adelite AT20Q" (see note below) was added at the rate of 6 and 12 grams/liter to a treatment liquor consisting of 5.2 grams/liter of $Cr^{6+}$ (anhydrous chromic acid), 0.2 grams/liter of $Cr^{3+}$ and 0.48 gram/liter of $NO_3-(HNO_3)$ and the pH was adjusted to 3 with ammonium hydroxide. (NOTE: A 20% solution of colloidal silica made by Asahi Denka)

| Cathodic Electrolysis Conditions | |
|---|---|
| Electrolysis Time | 8 seconds |
| Current Density | 15 A/dm$^2$ |
| Electrolysis Temperature | 30° C. |

REFERENCE EXAMPLE 4

Samples prepared by treating zinc electroplated steel sheet which has been cleaned with a known method under the same cathodic electrolysis conditions as in Example 4 using a treatment liquor corresponding to that used in Example 4 but from which $SiO_2$ had been omitted and a treatment liquor as used in Example 4 but in which the $SiO_2$ concentration had been reduced to 3 grams/liter were used for Reference Example 4 in Table 4.

EXAMPLE 5

Zinc electroplated steel sheet which has been cleaned using a known method was subjected to a cathodic electrolysis treatment under the conditions indicated below, washed with water after treatment and then dried and then the samples obtained in this way were compared with Reference Example 5 it was found that, as shown in Table 5, the film formed by means of a cathodic electrolysis treament of this invention displayed a higher film precipitation efficiency and better corrosion resistance and better paint film attachment properties than the films of Reference Example 5.

COMPOSITION OF THE TREATMENT LIQUORS $Cr^{3+}$ ion ($Cr^{6+}$ reduced with methanol) was added in such a way as to provide a $Cr^{3+}/Cr^{6+}$ ration of 1/50, 1/10, and ⅓, respectively to a treatment liquor to which 12 grams/liter of $Cr^{6+}$ (anhydrous chromic acid), 3 grams/liter of $NO^3-(HNO_3)$ and 100 grams/liter of "Snotex C" (see note below) had been added and the pH was adjusted to 5 with ammonium hydroxide. (Note: A 20% solution of colloidal silica made by Nissan Chemicals.)

| Cathodic Electrolysis Conditions | |
|---|---|
| Electrolysis Time | 1 second |
| Current Density | 50 A/dm$^2$ |
| Electrolysis Temperature | 30° C. |

REFERENCE EXAMPLE 5

Samples prepared by treating zinc electroplated steel sheet which had been cleaned using a known method under the same cathodic electrolysis conditions as in Example 5 and using the treatment liquors indicated below were used for Reference Example 5 in Table 5.

COMPOSITION OF THE TREATMENT LIQUOR $Cr^{3+}$ ion ($Cr^{3+}$ reduced with methanol) was added in such a way as to provide a $Cr^{3+}/Cr^{6+}$ ratio of 1/100 and 1/2.5, respectively, to a treatment liquor to which 12 grams/liter of $Cr^{6+}$ (anhydrous chromic acid), 3 grams/liter of $NO_3-$ ($HNO_3$), and 100 grams/liter of "Snotex C" (described above) had been added and the pH was adjusted to 5 with ammonium hydroxide.

| Cathodic Electrolysis Conditions | |
|---|---|
| Electrolysis Time | 1 second |
| Current Density | 50 A/dm$^2$ |
| Electrolysis Temperature | 30° C. |

EXAMPLE 6

Zinc electroplated steel sheet which has been cleaned using a known method was subjected to a cathodic electrolysis treatment under the conditions indicated below, washed with water after treatment and then dried and when the samples obtained in this way were compared with Reference Example 6 it was found that, as shown in Table 6, the film formed by means of a cathodic electrolysis treatment of this invention displayed better corrosion resistanc and better paint film attachment properties than the films of Reference Example 6.

| Composition of the Treatment Liquor | | |
|---|---|---|
| $Cr^{6+}$ | 10.4 grams/liter | (Anhydrous chromic acid) |
| $Cr^{3+}$ | 0.5 grams/liter | (Chromium carbonate) |
| Snotex C | 75.0 grams/liter | (A colloidal solution containing 20% $SiO_2$, made by Nissan Chemicals) |
| $NO_3^-$ | 3.0 grams/liter | ($HNO_3$) |

The pH was adjusted to 5.0 with sodium carbonate.

| Cathodic Electrolysis Conditions | |
|---|---|
| Electrolysis Time | 4 seconds |
| Current Density | 3, 6, 9 A/dm$^2$ |
| Electrolysis Temperature | 50° C. |

REFERENCE EXAMPLE 6

Samples prepared by treating zinc electroplated steel sheets which had been cleaned using a known method with the same treatment liquor as in Example 6 at current densities of 0 and 1.5 A/dm$^2$ were used for Reference Example 6 in Table 6.

| Cathodic Electrolysis Conditions | |
|---|---|
| Electrolysis Time | 4 seconds |
| Current Density | 0, 1.5 A/dm$^2$ |
| Electrolysis Temperature | 50° C. |

The methods used for the evaluation of data in Tables 1-6 were as indicated below:

(1) Fixation of the Film

Adhesive tape (50 mm wide) was stuck over the film and the residual Cr, Si in the film after stripping the tape off quickly was indicated in terms of percent. 100% was the best.

(2) Uniformity of the Film

The unevenness of the film was observed visually and assessed in 4 stages, namely, 1, 2, 3, and 4. Stage 1 was the best.

(3) Corrosion Resistance (3-1) Salt Water Spray Test

The state of rusting was assessed visually in 4 stages, namely 1, 2, 3, and 4 after carrying out a salt water spray test in accordance with the method laid down in JIS-Z-2371. Stage 1 was the best.

(4) Paint Film Adhesion Properties (Painting: painted with a commercial alkyd melamine based whie paint to a thickness of 27–30μ).

(4-1) Checkerboard Erikson Test

A checkerboard of 100 squares with a spacing of 1mm was cut into the paint film and then the material was pressed out 7mm using an Erikson tester. A stripping test was then carried out with Celelofan tape on the pressed out part and the state of peeling was assessed visually in four stages, namely 1, 2, 3, and 4. Stage 1 was the best.

(4-2) DuPont Type Impact Test

The film surface was subjected to an impact using a DuPont type impact tester and the extent of peeling of the paint film was assessed visually in 4 stages, namely 1, 2, 3, and 4. Stage 1 was the best.

TABLE 1

| METHOD OF TREATMENT | ELECTROLYSIS CONDITIONS: CURRENT DENSITY A/dm² | TIME (Sec) | EXTENT OF FILM FORMATION: Cr DEPOSITED (mg/m²) | Si DEPOSITED (mg/m²) | FILM FIXATION: Cr % | Si % | UNIFORMITY OF FILM | CORROSION RESISTANCE AFTER 24 HOURS SALT SPRAY | PAINT FILM ADHESION: CHECKERBOARD ERIKSON | DUPONT IMPACT |
|---|---|---|---|---|---|---|---|---|---|---|
| EXAMPLE 1 | | | | | | | | | | |
| CATHODIC ELECTROLYSIS | 10 | 3 | 16 | 13 | 95 | 95 | 1 | 2 | 1 | 1 |
| CATHODIC ELECTROLYSIS | 10 | 6 | 33 | 14 | 95 | 95 | 1 | 2 | 1 | 1 |
| CATHODIC ELECTROLYSIS | 10 | 12 | 66 | 14 | 95 | 95 | 1 | 1 | 1 | 1 |
| REFERENCE EXAMPLE 1 | | | | | | | | | | |
| COATING | — | — | 16 | 35 | 90 | 60 | 2 | 4 | 3 | 4 |
| COATING | — | — | 32 | 70 | 80 | 50 | 4 | 4 | 4 | 4 |
| COATING | — | — | 60 | 133 | 70 | 30 | 4 | 4 | 4 | 4 |

TABLE 2

| — | TREATMENT LIQUOR COMPOSITION: $Cr^{6+}$ g/l | $Cr^{3+}$ g/l | $SiO_2$ g/l | $NO_3^-$ g/l | pH | ELECTROLYSIS CONDITIONS: CURRENT DENSITY A/dm² | TIME (Sec) | EXTENT OF FILM FORMATION: Cr DEPOSITED (mg/m²) | Si DEPOSITED (mg/m²) | CORROSION RESISTANCE AFTER 48 HOURS SALT SPRAY | PAINT FILM ADHESION: CHECKERBOARD ERIKSON | DUPONT IMPACT |
|---|---|---|---|---|---|---|---|---|---|---|---|---|
| EXAMPLE 2* | 41.6 | 2.4 | 20 | 0.98 | 5 | 20 | 4 | 51 | 7 | 1 | 1 | 1 |
| REFERENCE | 41.6 | 2.4 | 0 | 0 | 5 | 20 | 4 | 46 | 0 | 4 | 4 | 4 |
| EXAMPLE 2 | 41.6 | 2.4 | 20 | 0 | 5 | 20 | 4 | 48 | 7 | 3 | 2 | 4 |
| | 41.6 | 2.4 | 0 | 0.98 | 5 | 20 | 4 | 50 | 0 | 3 | 4 | 3 |

NOTE*: $Cr^{3+}/Cr^{6+}$ = 1/17.33

TABLE 3

| | TREATMENT LIQUOR COMPOSITION: $Cr^{6+}$ g/l | $Cr^{3+}$ g/l | $SiO_2$ g/l | $NO_3^-$ g/l | pH | ELECTROLYSIS CONDITIONS: CURRENT DENSITY A/dm² | TIME (Sec) | EXTENT OF FILM FORMATION: Cr DEPOSITED (mg/m²) | Si DEPOSITED (mg/m²) | CORROSION RESISTANCE AFTER 24 HOURS SALT SPRAY | PAINT FILM ADHESION: CHECKERBOARD ERIKSON | DUPONT IMPACT |
|---|---|---|---|---|---|---|---|---|---|---|---|---|
| EXAMPLE 3* | 15.2 | 1.5 | 10 | 0.06 | 5 | 5 | 5 | 19 | 7 | 2 | 1 | 1 |
| | 15.2 | 1.5 | 10 | 0.12 | 5 | 5 | 5 | 20 | 7 | 2 | 1 | 1 |
| | 15.2 | 1.5 | 10 | 0.24 | 5 | 5 | 5 | 21 | 7 | 2 | 1 | 1 |
| REFERENCE | 15.2 | 1.5 | 10 | 0 | 5 | 5 | 5 | 17 | 6 | 3 | 2 | 3 |
| EXAMPLE 3 | 15.2 | 1.5 | 10 | 0.03 | 5 | 5 | 5 | 18 | 7 | 3 | 2 | 3 |

NOTE*: $Cr^{3+}/Cr^{6+}$ = 1/10.13

TABLE 4

| | TREATMENT LIQUOR COMPOSITION | | | | | ELECTROLYSIS CONDITIONS | | EXTENT OF FILM FORMATION | | CORROSION RESISTANCE AFTER 48 HOURS SALT SPRAY | PAINT FILM ADHESION | |
|---|---|---|---|---|---|---|---|---|---|---|---|---|
| | $Cr^{6+}$ g/l | $Cr^{3+}$ g/l | $SiO_2$ g/l | $NO_3-$ g/l | pH | CURRENT DENSITY A/dm² | TIME (Sec) | Cr DEPOSITED (mg/m²) | Si DEPOSITED (mg/m²) | | CHECKERBOARD ERIKSON | DUPONT IMPACT |
| EXAMPLE 4* | 5.2 | 0.2 | 6 | 0.48 | 3 | 15 | 8 | 82 | 4 | 1 | 2 | 2 |
| | 5.2 | 0.2 | 12 | 0.48 | 3 | 15 | 8 | 84 | 8 | 1 | 1 | 2 |
| REFERENCE | 5.2 | 0.2 | 0 | 0.48 | 3 | 15 | 8 | 78 | 0 | 2 | 4 | 4 |
| EXAMPLE 4 | 5.2 | 0.2 | 3 | 0.48 | 3 | 15 | 8 | 81 | 1 | 2 | 3 | 4 |

NOTE*: $Cr^{3+}/Cr^{6+}$ = 1/26

TABLE 5

| | | TREATMENT LIQUOR COMPOSITION | | | | | ELECTROLYSIS CONDITIONS | | EXTENT OF FILM FORMATION | | CORROSION RESISTANCE AFTER 48 HOURS SALT SPRAY | PAINT FILM ADHESION | |
|---|---|---|---|---|---|---|---|---|---|---|---|---|---|
| | | $Cr^{6+}$ g/l | $Cr^{3+}$ g/l | $SiO_2$ g/l | $NO_3-$ g/l | pH | CURRENT DENSITY A/dm² | TIME (Sec) | Cr DEPOSITED (mg/m²) | Si DEPOSITED (mg/m²) | | CHECKERBOARD ERIKSON | DUPONT IMPACT |
| EXAMPLE 5* | (a) | 12 | 0.24 | 20 | 3 | 5 | 50 | 1 | 48 | 12 | 2 | 1 | 1 |
| | (b) | 12 | 1.2 | 20 | 3 | 5 | 50 | 1 | 54 | 12 | 1 | 1 | 1 |
| | (c) | 12 | 4.0 | 20 | 3 | 5 | 50 | 1 | 60 | 12 | 1 | 1 | 1 |
| REFERENCE | | 12 | 0.12 | 20 | 3 | 5 | 50 | 1 | 45 | 9 | 4 | 3 | 4 |
| EXAMPLE 5 | | 12 | 4.8 | 20 | 3 | 5 | 50 | 1 | 69 | 10 | 3 | 4 | 3 |

NOTE*: (a) $Cr^{3+}/Cr^{6+}$ = 1/50, (b) $Cr^{3+}/Cr^{6+}$ = 1/10, (c) $Cr^{3+}/Cr^{6+}$ = ⅓

TABLE 6

| | TREATMENT LIQUOR COMPOSITION | | | | | ELECTROLYSIS CONDITIONS | | EXTENT OF FILM FORMATION | | CORROSION RESISTANCE AFTER 24 HOURS SALT SPRAY | PAINT FILM ADHESION | |
|---|---|---|---|---|---|---|---|---|---|---|---|---|
| | $Cr^{6+}$ g/l | $Cr^{3+}$ g/l | $SiO_2$ g/l | $NO_3-$ g/l | pH | CURRENT DENSITY A/dm² | TIME (Sec) | Cr DEPOSITED (mg/m²) | Si DEPOSITED (mg/m²) | | CHECKERBOARD ERIKSON | DUPONT IMPACT |
| EXAMPLE 6* | 10.4 | 0.5 | 15 | 3 | 5 | 3 | 4 | 17 | 6 | 3 | 2 | 2 |
| — | 10.4 | 0.5 | 15 | 3 | 5 | 6 | 4 | 38 | 6 | 1 | 1 | 1 |
| | 10.4 | 0.5 | 15 | 5 | 9 | 4 | 4 | 55 | 7 | 1 | 1 | 1 |
| REFERENCE | 10.4 | 0.5 | 15 | 3 | 0 | 4 | 2 | 0 | 4 | 4 | 4 | |
| EXAMPLE 6 | 10.4 | 0.5 | 15 | 3 | 5 | 1.5 | 4 | 5 | 1 | 4 | 4 | 4 |

NOTE*: $Cr^{3+}/Cr^{6+}$ = 1/20.8

TABLE 7

| COMPOSITION OF THE TREATMENT LIQUOR | CATHODIC ELECTROLYSIS CONDITIONS | | | | EXTENT OF FILM FORMATION | |
|---|---|---|---|---|---|---|
| | CURRENT DENSITY A/dm² | TIME (Sec) | QUANTITY OF ELECTRICITY Coulombs/dm² | TEMPERATURE °C. | Cr DEPOSITED mg/m² | Si DEPOSITED mg/m² |
| $Cr^{6+}$ 30 grams/liter | 10 | 1 | 10 | 40 | 5 | 12 |
| $Cr^{3+}$ - 5 grams/liger | 20 | 1 | 20 | 40 | 10 | 12 |
| Snotex 0* - 100 grams/liter | 30 | 1 | 30 | 40 | 16 | 12 |
| $HNO_3$ - 0.5 grams/liter | 40 | 1 | 40 | 40 | 21 | 12 |
| pH - 2 | 50 | 1 | 50 | 40 | 25 | 13 |
| | 60 | 1 | 60 | 40 | 32 | 13 |
| | 70 | 1 | 70 | 40 | 37 | 13 |
| | 80 | 1 | 80 | 40 | 44 | 14 |

*20% solution of $SiO_2$, made by Nissan Chemicals

What is claimed is:

1. A method for the treatment of surfaces of zinc plated steel comprising subjecting the surface to a cathodic electrolysis treatment at a cathodic current density of from 3 to 80 A/dm² in an aqueous treatment liquor which contains 5–70 grams/liter of $Cr^{6+}$, 0.01–5.0 grams/liter of $Cr^{3+}$, 5–100 grams/liter of silica and/or silicate and 0.05–10 grams/liter of $NO_3-$ ion and in which the ratio $Cr^{3+}/Cr^{6+}$ is within the range of 1/50–⅓.

2. The method of claim 1 wherein the concentration of the $Cr^{6+}$ in the treatment liquor is 10–50 grams/liter, the concentration of the $Cr^{3+}$ is 0.05–5.0 grams/liter, the concentration of the silica and/or silicate is 10–50 grams/liter and the concentration of the $NO_3$- ion is 0.1–3 grams/liter.

3. The method of claim 1 wherein the pH of the treatment liquor is 1–6 and the temperature of the treatment liquor is from room temperature to 70° C.

4. The method of claim 1 wherein the deposition of chromium on the surface is from 10–300 mg/m².

* * * * *